US010011448B1

(12) United States Patent
Sugiyama

(10) Patent No.: US 10,011,448 B1
(45) Date of Patent: Jul. 3, 2018

(54) SHEET TRANSPORT APPARATUS AND SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hideaki Sugiyama, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/394,220

(22) Filed: Dec. 29, 2016

(51) Int. Cl.
*B65H 9/16* (2006.01)
*B65H 9/00* (2006.01)

(52) U.S. Cl.
CPC ..... *B65H 9/002* (2013.01); *B65H 2301/331* (2013.01); *B65H 2404/137* (2013.01); *B65H 2404/1311* (2013.01); *B65H 2404/13162* (2013.01); *B65H 2404/13163* (2013.01); *B65H 2404/1542* (2013.01); *B65H 2511/21* (2013.01); *B65H 2515/81* (2013.01)

(58) Field of Classification Search
CPC ..... B65H 9/002; B65H 2301/331; B65H 2404/1311; B65H 2404/1316; B65H 2404/13161; B65H 2404/13162; B65H 2404/13163; B65H 2404/137; B65H 2404/1542; B65H 2511/21
See application file for complete search history.

(56) References Cited

U.S. PATENT DOCUMENTS

| | | | | |
|---|---|---|---|---|
| 2,592,581 | A * | 4/1952 | Lorig | B65H 23/02 156/405.1 |
| 3,339,818 | A * | 9/1967 | Morrow | B65G 39/071 226/190 |
| 3,961,736 | A * | 6/1976 | Fatula | B65H 27/00 198/842 |
| 5,431,321 | A * | 7/1995 | Link | B65H 27/00 226/190 |
| 8,191,817 | B2 * | 6/2012 | Wohlfahrt | B65H 19/2253 242/541 |
| 8,360,423 | B2 * | 1/2013 | Biegelsen | B41J 3/60 271/264 |
| 8,915,492 | B2 | 12/2014 | Sugiyama et al. | |
| 9,206,005 | B2 * | 12/2015 | Fujita | B65H 5/068 |
| 2010/0164164 | A1 * | 7/2010 | Kondo | B65H 9/002 271/3.24 |

* cited by examiner

*Primary Examiner* — Jeremy R Severson
(74) *Attorney, Agent, or Firm* — Patterson & Sheridan, LLP

(57) ABSTRACT

A sheet transport apparatus according to an embodiment includes a roller having a surface formed from an elastic material. The roller transports a sheet. A rotation mechanism rotated the roller around an axis of the roller. A twist mechanism selectively twists the roller with respect to the axis. When the roller is twisted and the rotation mechanism rotates the roller, a sheet transported by the roller is transported in a first direction perpendicular to the axis and in a second direction parallel to the axis. When the roller is not twisted and the rotation mechanism rotates the roller, a sheet transported by the roller is transported in the first direction and not in the second direction.

17 Claims, 7 Drawing Sheets

SHEET TRANSPORT APPARATUS AND SHEET PROCESSING APPARATUS

FIELD

Embodiments described herein relate generally to a sheet transport apparatus and a sheet processing apparatus.

BACKGROUND

Generally, in an image forming system or the like, a sheet transport apparatus including a roller is used. By rotating the roller around an axis of the roller, a sheet in contact with the roller is transported in a direction perpendicular to the axis.

For a sorting process or the like of the sheet, there is a case where the sheet is moved in a direction along the axis of the roller, which is a width direction of the sheet. To allow the sheet to move in the direction along the axis of the roller, the roller is separated from the sheet. The sheet is moved in the direction along the axis by a unit different from the roller.

The time required for moving the sheet in contact with the roller in the direction perpendicular to the axis of the roller and also in the direction along the axis of the roller may be inconvenient.

DETAILED DESCRIPTION

A sheet transport apparatus according to an embodiment includes a roller having a surface formed from an elastic material. The roller transports a sheet. A rotation mechanism rotated the roller around an axis of the roller. A twist mechanism selectively twists the roller with respect to the axis. When the roller is twisted and the rotation mechanism rotates the roller, a sheet transported by the roller is transported in a first direction perpendicular to the axis and in a second direction parallel to the axis. When the roller is not twisted and the rotation mechanism rotates the roller, a sheet transported by the roller is transported in the first direction and not in the second direction.

Hereinafter, a sheet transport apparatus and a sheet processing apparatus according to an embodiment will be described with reference to the drawings.

Figure 1:
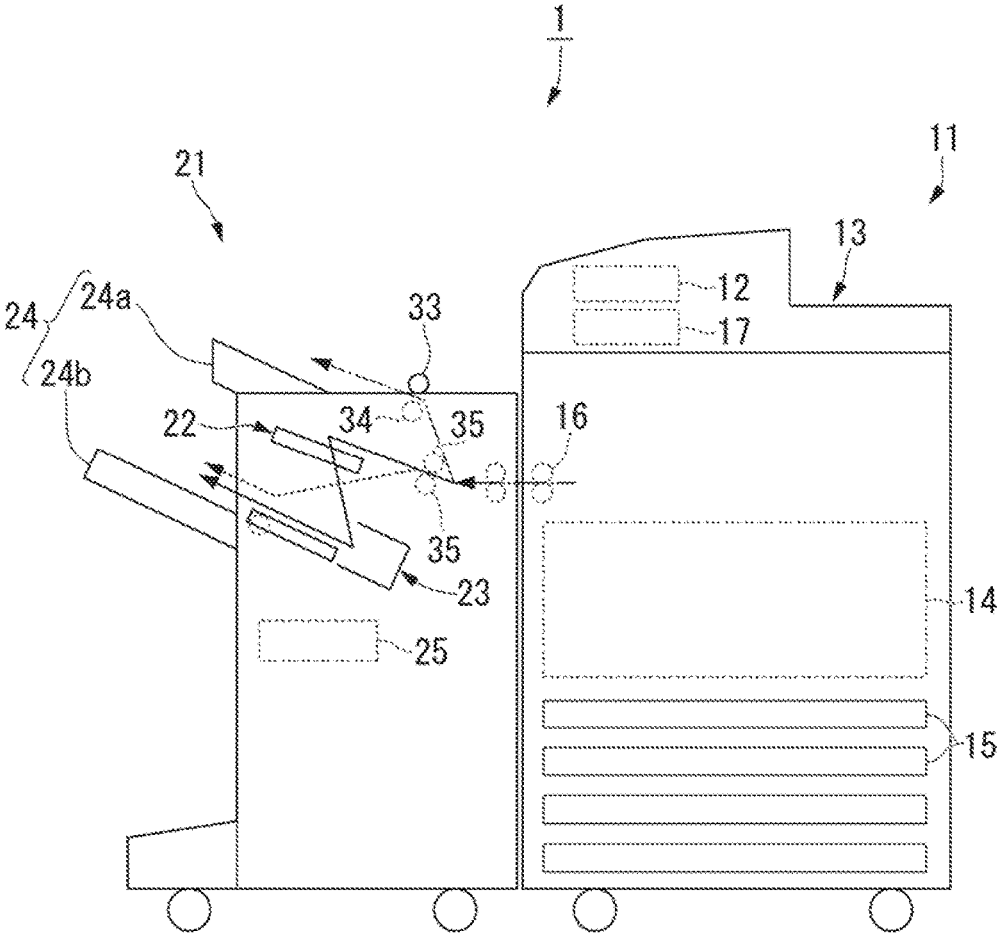
FIG. 1 is a front view schematically illustrating an overall configuration of an example image forming system in which a sheet transport apparatus of an embodiment is used.
Figure 2:
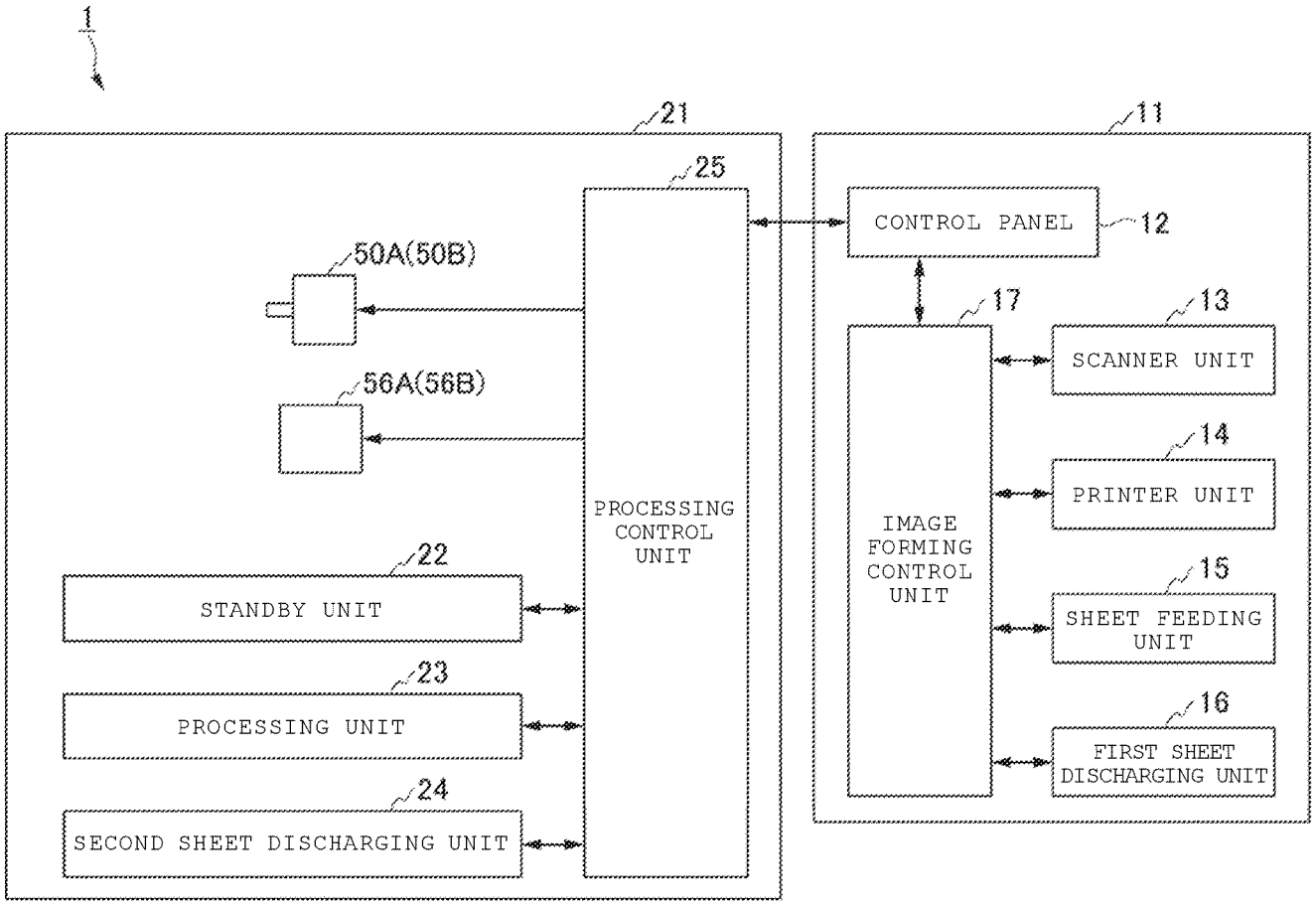
FIG. 2 is a block diagram of the image forming system.

In an image forming system 1 illustrated in FIG. 1 and FIG. 2, a sheet processing apparatus 21 and a sheet transport apparatus 38 of the embodiment described below are illustrated. The image forming system 1 includes an image forming apparatus 11 and the sheet processing apparatus 21.

The image forming apparatus 11 forms an image on a sheet. More particularly, the image forming apparatus 11 includes a control panel 12, a scanner unit 13, a printer unit 14, a sheet feeding unit 15, a first sheet discharging unit 16, and an image forming control unit 17.

The control panel 12 includes various keys for receiving operation input from a user. The control panel 12 sends information relating to a discharge destination or information relating to a sorting process of the sheet to the sheet processing apparatus 21. The scanner unit 13 includes a reading unit for generating image data from a copy object. The scanner unit 13 transmits the generated image data to the printer unit 14.

The printer unit 14 forms an image (hereinafter, referred to as a "toner image") on a sheet with a developer such as toner. The toner image is formed based on the image information transmitted from the scanner unit 13 or from an external device.

The sheet feeding unit 15 supplies sheets to the printer unit 14 one by one, in accordance with a time during which the printer unit 14 forms the toner image.

The first sheet discharging unit 16 transports the sheets discharged from the printer unit 14 to the sheet processing apparatus 21.

The image forming control unit 17 controls the entirety of operations of the image forming apparatus 11. That is, the image forming control unit 17 controls the control panel 12, the scanner unit 13, the printer unit 14, the sheet feeding unit 15, and the first sheet discharging unit 16. For example, the image forming control unit 17 is configured with a control circuit including a central processing unit (CPU), and a random access memory (RAM).

Next, the sheet processing apparatus 21 will be described.

The sheet processing apparatus 21 is positioned in the vicinity of the image forming apparatus 11. The sheet processing apparatus 21 performs a process on the sheets transported from the image forming apparatus 11, according to instructions received through the control panel 12. The sheet processing apparatus 21 includes a standby unit 22, a processing unit 23, a second sheet discharging unit (sheet discharging unit) 24, and a processing control unit (control unit) 25.

The standby unit 22 temporarily stores (buffers) the sheets transported from the image forming apparatus 11. For example, the standby unit 22 holds a subsequent plurality of sheets, while a process on preceding sheets is performed in the processing unit 23. The standby unit 22 drops the held sheet(s) toward the processing unit 23, when the processing unit 23 is available.

The processing unit 23 performs the process on the sheets. The process may be a sorting process, stapling, or the like. The processing unit 23 discharges the sheets on which the process is performed to the second sheet discharging unit 24.

The second sheet discharging unit 24 includes a fixed tray 24*a* and a movable tray 24*b*. The fixed tray 24*a* is provided on an upper portion of the sheet processing apparatus 21. Meanwhile, the movable tray 24*b* is provided on a side portion of the sheet processing apparatus 21. The movable tray 24*b* can be moved in a vertical direction along the side portion of the sheet processing apparatus 21. A sheet is discharged to either the fixed tray 24*a* or the movable tray 24*b*, according to a discharge destination of the sheet selected through the control panel 12.

The second sheet discharging unit 24 receives the sheet outside of the sheet processing apparatus 21.

Next, a configuration of each unit of the sheet processing apparatus 21 will be described in detail.

In the following description, an "upstream side" and a "downstream side" refers to an upstream side in a sheet transport direction and a downstream side in the sheet transport direction, respectively.

Figure 3:
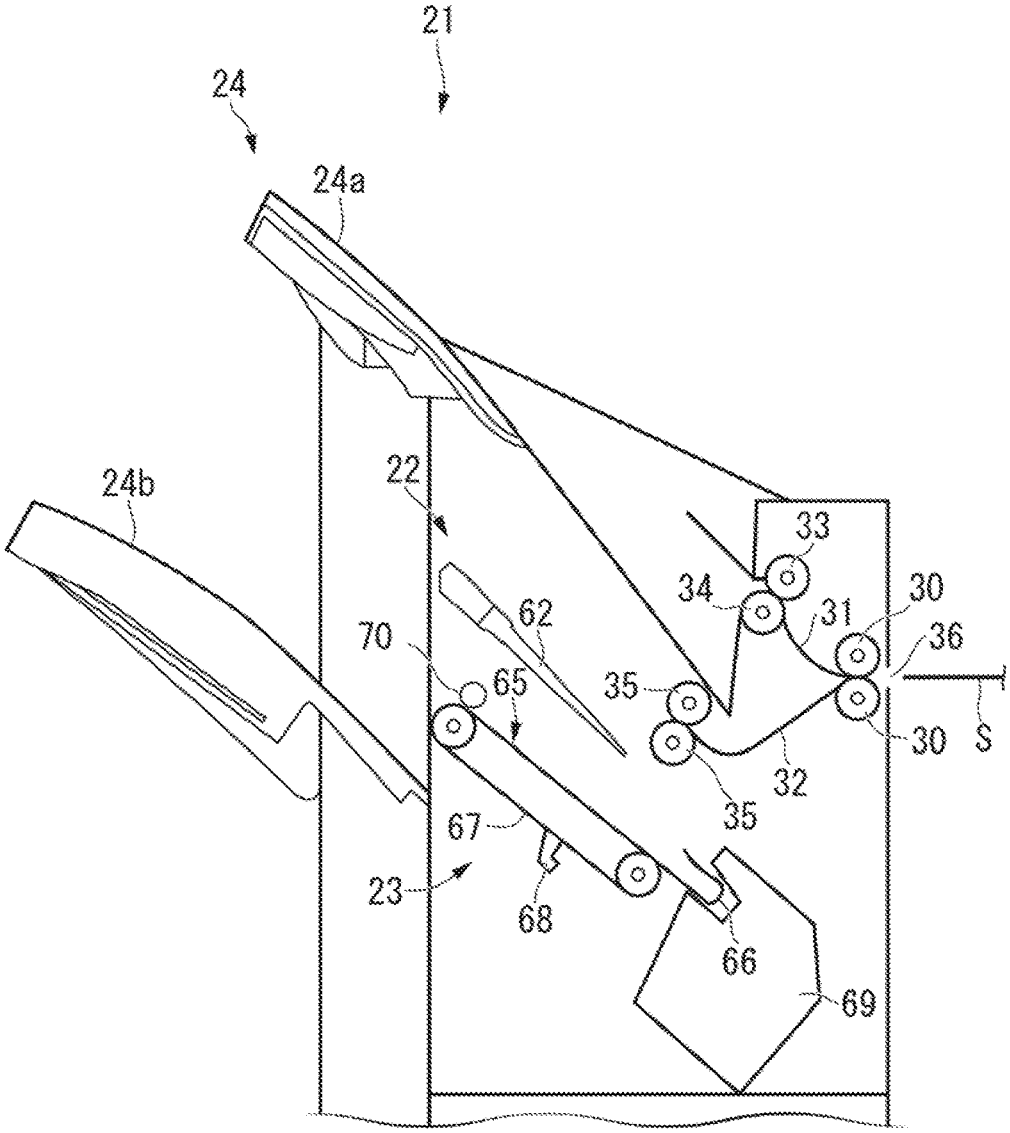
FIG. 3 is a sectional view schematically illustrating a sheet processing apparatus.

As illustrated in FIG. 3, the sheet processing apparatus 21 includes inlet rollers 30, transport paths 31 and 32 along which the sheet S is transported, a drive discharge roller (roller) 33, a driven discharge roller 34, and outlet rollers 35.

The inlet rollers 30 are provided in the vicinity of a sheet supply port 36 of the sheet processing apparatus 21. The inlet rollers 30 transport the sheet S supplied from the sheet supply port 36 toward an inside of the sheet processing apparatus 21.

The transport paths 31 and 32 include a first transport path 31 and a second transport path 32. The first transport path 31 is provided between the inlet rollers 30 and the fixed tray 24*a* of the second sheet discharging unit 24. The discharge rollers 33 and 34 are provided in a downstream end portion of the first transport path 31.

Figure 4:
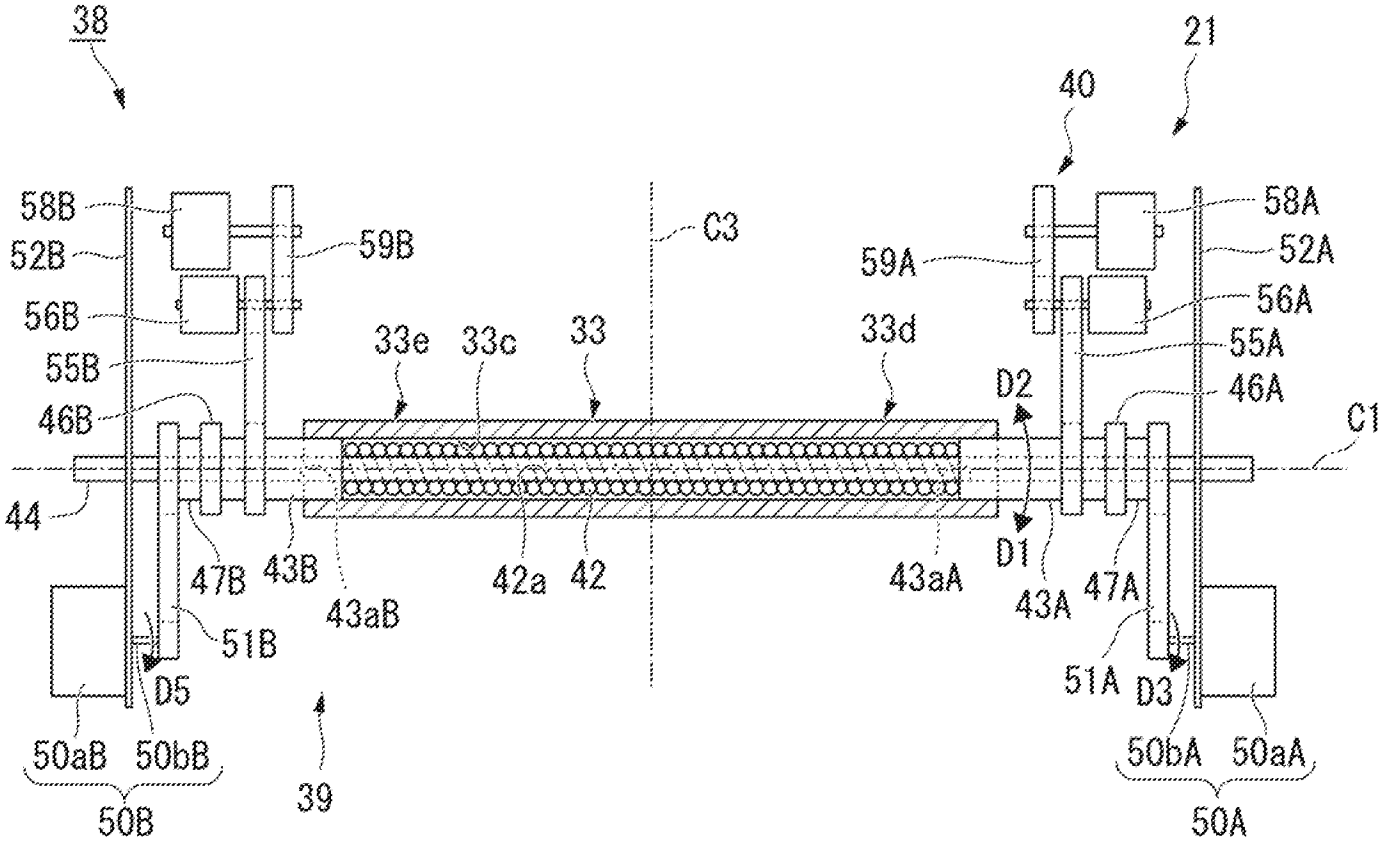
FIG. 4 is a plan partial cut-away view schematically illustrating the sheet transport apparatus.

As illustrated in FIG. 4, the sheet transport apparatus 38 of the embodiment includes the drive discharge roller 33, a rotation mechanism 39, and a twist mechanism 40. The sheet processing apparatus 21 includes the sheet transport apparatus 38.

Figure 5:
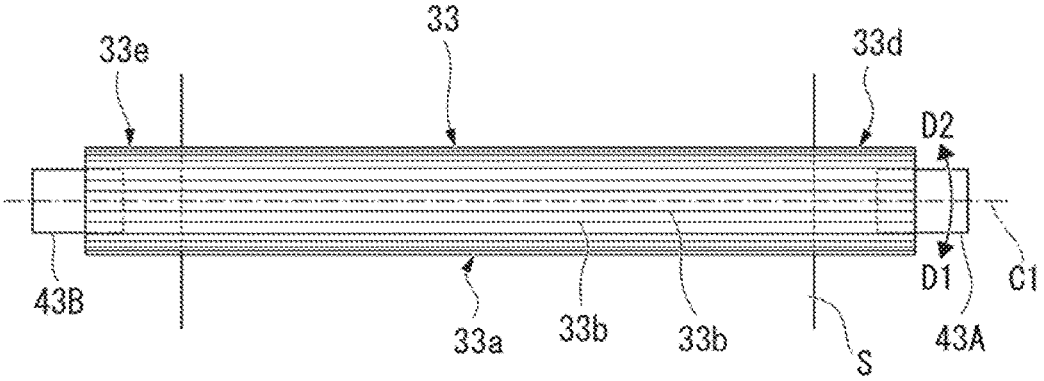
FIG. 5 is a plan view of a drive discharge roller in an initial state.
Figure 6:
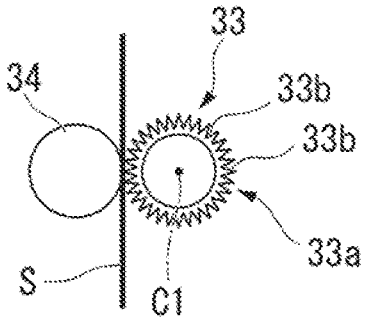
FIG. 6 is a side view of the drive discharge roller in the initial state.

The drive discharge roller 33 illustrated in FIG. 5 and FIG. 6 is in an initial state. When the drive discharge roller 33 is in the initial state, no twisting force is applied to the drive discharge roller 33 around an axis line C1 of the drive discharge roller 33. The drive discharge roller 33 is formed in a cylindrical shape and formed from an elastic material such as rubber.

An uneven surface 33*a* is formed on an outer periphery surface of the drive discharge roller 33. A plurality of grooves 33*b* are formed on the uneven surface 33*a*, extending along the axis line C1. The grooves 33*b* are formed at intervals in a circumferential direction around the drive discharge roller 33. The drive discharge roller 33 rotates around the axis line C1 to thereby transport the sheet S in contact with the drive discharge roller 33. The drive discharge roller 33 pinches the sheet S together with the driven discharge roller 34.

As illustrated in FIG. 4, a coil 42 is disposed within a cylindrical hole 33*c* of the drive discharge roller 33. For example, the coil 42 is formed by spirally winding a wire formed from an elastic material such as metal. It is preferable that the coil 42 is not wound tightly in an initial state. This is because when the coil 42 is wound tightly, it is difficult to deform the coil 42 so as to decrease a length of the coil 42 in a direction (hereinafter, referred to as a C1 direction) along the axis line C1.

The drive discharge roller 33 and the coil 42 may also be bonded to each other by an adhesive or the like. Alternatively he drive discharge roller 33 and the coil 42 may not be bonded.

The configuration of a first end portion 33*d* and a second end portion 33*e* of the drive discharge roller 33 in the C1 direction and described below is symmetric with respect to a reference surface C3 perpendicular to the C1 direction. For this reason, the configuration provided in the first end portion 33*d* is specified by giving a number or a capital letter "A" to the number and the lowercase letter. The configuration provided in the second end portion 33*e* is specified by giving the above-described number or a capital letter "B" to the number and the lowercase letter. Thus, redundant description will be omitted. For example, a first collar 43A and a first collar 43B which will be described below are symmetric with respect to the reference surface C3 and have an identical structure.

The cylindrical first collar 43A formed from metal or the like is positioned in an end portion of the coil 42 in the C1 direction. An inner diameter of the first collar 43A is equal to an inner diameter of the coil 42. An outer diameter of the first collar 43A is equal to or greater than an outer diameter of the coil 42. The first collar 43A and the coil 42 are arranged at different positions in the axis line C1 direction.

The coil 42 and the first collar 43A are bonded to each other, for example by welding, an adhesive, or the like. A part of the first collar 43A is disposed within the cylindrical hole 33*c* of the drive discharge roller 33. The drive discharge roller 33 and the first collar 43A are fixed to each other, for example by press fit, an adhesive, or the like.

A shaft (shaft member) 44 is arranged inside a cylindrical space 42*a* of the coil 42 and inside a cylindrical space 43*a*A of the first collar 43A. An end portion of the shaft 44 in the C1 direction protrudes from the first collars 43A and a second collar 47A as described below. The drive discharge roller 33, the coil 42, and the first collars 43A and 43B can rotate around the axis line C1 with respect to the shaft 44.

The first collar 43A is connected to the second collar 47A through a first drive switching unit 46A. The second collar 47A is formed in a cylindrical shape similar to the first collar 43A. The first drive switching unit 46A is configured with a known one-way clutch or the like. The first drive switching unit 46A and the second collar 47A can rotate around the axis line C1 with respect to the shaft 44.

The first drive switching unit 46A regulates rotation of the second collar 47A in a first direction D1 around the axis line C1 relative to the first collar 43A. The first drive switching unit 46A allows the rotation of the second collar 47A in a second direction D2 around the axis line C1 with respect to the first collar 43A. The second direction D2 is a direction opposite to the first direction D1.

The second drive switching unit 46B regulates rotation of the second collar 47B in the first direction D1 around the axis line C1 relative to the first collar 43B. The second drive switching unit 46B allows the rotation of the second collar 47B in the second direction D2 around the axis line C1 with respect to the first collar 43B.

The rotation mechanism 39 includes a first motor (first drive unit) 50A, a drive belt 51A, a second motor (second drive unit) 50B, and a drive belt 51B.

The first motor 50A includes a motor main body 50*a*A and a drive shaft 50*b*A. The drive shaft 50*b*A rotates around an axis line with respect to the motor main body 50*a*A. The motor main body 50*a*A is fixed to a frame or the like (not illustrated) of the sheet processing apparatus 21 through a supporting plate 52A. The supporting plate 52A also supports the shaft 44. A stepping motor may be used as the first motor 50A.

The drive belt 51A is wound around the drive shaft 50*b*A and the second collar 47A. When the first motor 50A is driven, the drive shaft 50*b*A rotates in a direction D3 around the axis line with respect to the motor main body 50*a*A. The first motor 50A applies torque to the first end portion 33*d* of the drive discharge roller 33, which rotates the first end portion 33*d* of the drive discharge roller 33 in the first direction D1 around the axis line C1.

When the second motor 50B is driven, a drive shaft 50*b*B rotates in a direction D5 around the axis line with respect to a motor main body 50*a*B. The second motor 50B applies torque to the second end portion 33*e* of the drive discharge roller 33, which rotates the second end portion 33*e* of the drive discharge roller 33 in the first direction D1 around the axis line C1. The rotation mechanism 39 rotates the drive discharge roller 33 around the axis line C1.

The first drive switching unit 46A transmits torque in the direction D3 provided by the drive shaft 50*b*A of the first motor 50A as torque in the first direction D1 around the axis line C1 at the first end portion 33*d* of the drive discharge roller 33. The first drive switching unit 46A regulates transmission of torque, which is applied in the first direction D1 around the axis line C1 to the first end portion 33*d* of the drive discharge roller 33, to the first motor 50A.

The second drive switching unit 46B transmits torque in the direction D5 provided by the drive shaft 50*b*B of the second motor 50B as torque in the first direction D1 around the axis line C1 at the second end portion 33*e* of the drive discharge roller 33. The second drive switching unit 46B regulates transmission of torque, which is applied in the first direction D1 around the axis line C1 to the second end portion 33*e* of the drive discharge roller 33, to the second motor 50B.

As illustrated in FIG. 4, a second regulation switching unit 56A is connected to the second collar 47A through a belt 55A. The second regulation switching unit 56A is configured with a known electromagnetic clutch or the like.

The second regulation switching unit 56A is selectively switched to any one of a second regulation transmission state and a second regulation release state. During the second regulation transmission state, torque is transmitted between the first end portion 33*d* of the drive discharge roller 33 and the second regulation unit 58A which will be described below. During the second regulation release state, the torque is not transmitted between the first end portion 33*d* of the drive discharge roller 33 and the second regulation unit 58A.

A first regulation switching unit 56B is selectively switched to any one of a first regulation transmission state and a first regulation release state. During the first regulation transmission state, torque is transmitted between the second end portion 33*e* of the drive discharge roller 33 and a first regulation unit 58B. During the first regulation release state, the torque is not transmitted between the second end portion 33*e* of the drive discharge roller 33 and the first regulation unit 58B.

The twist mechanism 40 includes the second regulation unit 58A and the first regulation unit 58B. The regulation units 58A and 58B are configured with a known torque limiter or the like. The second regulation unit 58A is connected to the second regulation switching unit 56A through a belt 59A.

The second regulation unit 58A applies torque to the first end portion 33*d* of the drive discharge roller 33, which rotates the first end portion 33*d* of the drive discharge roller 33 in the second direction D2 around the axis line C1. The first regulation unit 58B applies the torque which rotates the rotation mechanism 39 in the second direction D2 around the axis line C1 to the second end portion 33*e* of the drive discharge roller 33.

The magnitude of the torque applied by the second motor 50B is greater than that of the torque applied by the second regulation unit 58A. Similarly, the magnitude of torque applied by the first motor 50A is greater than that of the torque applied by the first regulation unit 58B. Accordingly, the twist mechanism 40 twists the drive discharge roller 33 around the axis line C1.

As described below, by rotating the drive discharge roller 33 in a state in which the drive discharge roller 33 is twisted, it is possible to sort the sheet S in a width direction of the sheet S which is the axis line C1 direction.

The driven discharge roller 34 rotates along with rotation of the drive discharge roller 33 around the axis line C1 by the rotation mechanism 39. As illustrated in FIG. 3, the discharge rollers 33 and 34 discharge the sheet S transported through the first transport path 31 toward the fixed tray 24*a*.

Meanwhile, the second transport path 32 is provided between the inlet rollers 30 and the outlet rollers 35. The outlet rollers 35 are provided in a downstream end portion of the second transport path 32. For example, the outlet rollers 35 transport the sheet S transported through the second transport path 32 toward the standby unit 22.

The standby unit 22 includes a pair of standby trays 62 (one of the standby trays 62 is not illustrated) and an opening and closing drive unit (not illustrated). The pair of standby trays 62 is arranged in parallel with the width direction of the sheet S intersecting the transport direction of the sheet S. An upstream end portion of each standby tray 62 is positioned slightly below an outlet of the second transport path 32. The sheet S is transported from the second transport path 32 to the pair of standby trays 62. The pair of standby trays 62 holds the plurality of sheets S stacked thereon, while the process is performed in the processing unit 23 with respect to previous sheets. A processing tray 65 of the processing unit 23 (which will be described below) is disposed below the pair of standby trays 62.

The opening and closing drive unit can move the pair of standby trays 62 in the width direction. When the standby trays 62 approach each other in the width direction, the plurality of sheets S are supported on the pair of standby trays 62. When the standby trays 62 are separated from each other in the width direction, the plurality of sheets S supported on the standby tray 62 are moved to the processing tray 65.

The processing unit 23 includes a processing tray 65, an ejector 66, a bundle hook belt 67, a bundle hook 68, a stapler 69, and a discharge roller 70.

The processing tray 65 is inclined with respect to a horizontal direction so as to gradually rise toward the downstream side. The processing tray 65 constitutes a part of a transport path.

The ejector 66 holds a plurality of sheets S on the processing tray 65. The bundle hook belt 67 is formed in an annular shape so that the transport direction is a major axis thereof. The bundle hook 68 is fixed to the bundle hook belt 67. The bundle hook 68 holds the plurality of sheets S. When the bundle hook belt 67 rotates, the bundle hook 68 transports the plurality of sheets S toward the downstream side.

The stapler 69 performs stapling (binding) on a bundle of the plurality of sheets S supported on the processing tray 65. Stapling is an example of the processing performed by the sheet processing apparatus 21; however, the processing is not limited thereby. The discharge roller 70 is provided in a downstream end portion of the processing tray 65. The discharge roller 70 discharges the plurality of sheets S supported on the processing tray 65 toward the movable tray 24*b* of the second sheet discharging unit 24.

The sheet processing apparatus 21 transports the sheet S on a first transport path 31, a second transport path 32, and a transport path including the processing tray 65. The inlet rollers 30, the drive discharge roller 33, the outlet rollers 35, and the discharge roller 70 are a plurality of sheet transport rollers provided in the sheet processing apparatus 21. Each sheet transport roller is a roller that transports the sheet S by rotation. The drive discharge roller 33 is the closest sheet transport roller to the fixed tray 24*a* of the second sheet discharging unit 24, on the first transport path 31, among the plurality of sheet transport rollers.

The processing control unit 25 is configured similar to the image forming control unit 17. As illustrated in FIG. 2, the processing control unit 25 controls the motors 50A and 50B, the regulation switching units 56A and 56B, the standby unit 22, the processing unit 23, and the second sheet discharging unit 24.

Next, an operation of the image forming system 1 configured as described above will be described with an emphasis on an operation of the sheet transport apparatus 38 of the sheet processing apparatus 21.

A user starts the image forming system 1 by operating the control panel 12. For example, the user selects the fixed tray 24*a* as a discharge destination of the sheet S by operating the control panel 12, and inputs instructions for sorting the sheet S in the axis line C1 direction. The image forming apparatus 11 transports the sheet S on which a toner image is formed from the sheet supply port 36 toward the inside of the sheet processing apparatus 21.

The sheet processing apparatus 21 transports the sheet S through the first transport path 31. For example, the plurality of sheets S may be alternately staggered in the width direction of the sheet S.

The processing control unit 25 drives the first motor 50A, and does not drive the second motor 50B. The first regulation switching unit 56B is set to the first regulation transmission state, and the second regulation switching unit 56A is set to the second regulation release state (first sorting).

When the first motor 50A is driven, the drive shaft 50*b*A rotates in the direction D3. The first motor 50A applies torque. When the second collar 47A rotates in the first direction D1, the torque is transmitted from the second collar 47A to the first collar 43A through the first drive switching unit 46A. The torque is transmitted from the first collar 43A to the first end portion 33*d* of the drive discharge roller 33.

Figure 7:
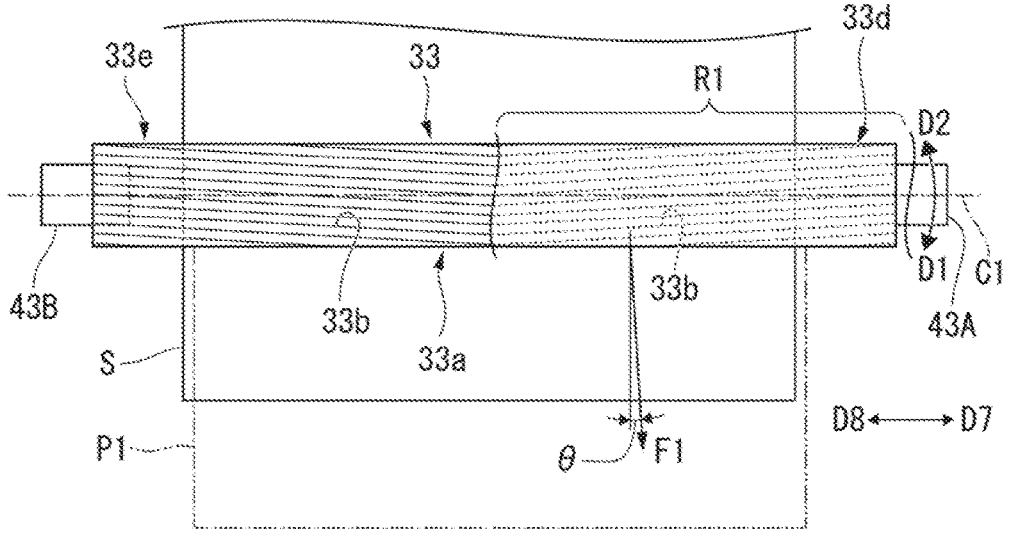
FIG. 7 is a plan and partial cut-away view of the drive discharge roller in a first twist state.

Since the second regulation switching unit 56A is in the second regulation release state, torque provided by the second regulation unit 58A is not applied to the first end portion 33*d* of the drive discharge roller 33. Since the first regulation switching unit 56B is in the first regulation transmission state, torque provided by the first regulation unit 58B is applied to the second end portion 33*e* of the drive discharge roller 33. The first collar 43B freely (without being regulated) rotates in the first direction D1 around the axis line C1 with respect to the second collar 47B by the second drive switching unit 46B. The magnitude of torque applied by the first motor 50A is greater than the magnitude of torque applied by the first regulation unit 58B. As illustrated in FIG. 7, the first end portion 33*d* of the drive discharge roller 33 is twisted in the first direction D1 with respect to the second end portion 33*e*. FIG. 7 illustrates a range R1 of the first end portion 33*d* of the drive discharge roller 33 in a partially cut-away manner.

The first motor 50A and the first regulation unit 58B twist the drive discharge roller 33 against elastic force of the drive discharge roller 33 and the coil 42. The coil 42 and the first collars 43A and 43B rotate around the shaft 44. Hereinafter, a state in which the drive discharge roller 33 is twisted in this manner is referred to as a first twist state. Each of the grooves 33*b* of the drive discharge roller 33 is twisted in a spiral shape. In the range R1, a direction in which each of the grooves 33*b* in contact with the sheet S is twisted is illustrated with broken lines.

The sheet S in contact with the drive discharge roller 33 is moved in a direction F1 perpendicular to a direction to which each groove 33*b* in contact with the sheet S extends. In other words, the sheet S transported by the drive discharge roller 33 of the first twist state is transported not only in a direction (hereinafter, referred to as perpendicular direction) perpendicular to the axis line C1, but also moved in a first direction D7 (parallel to the C1 direction). The sheet S is thereby moved to a position P1. Since the uneven surface 33*a* is formed on the drive discharge roller 33, the sheet S is moved in the first direction D7 by the drive discharge roller 33 of the first twist state.

As an amount by which the first end portion 33*d* of the drive discharge roller 33 is twisted in the first direction D1 increases, an angle θ at which the sheet S is skewed in the first direction D7 with respect to the perpendicular direction increases.

In the above process, the first sorting through which sheets S are staggered in the first direction D7 is completed. For transporting the sheet S in the perpendicular direction, it is not necessary for the drive discharge roller 33 to be separated from the sheet S. Thus, there is no requirement for an apparatus different from the sheet transport apparatus 38 to move the sheet S in the C1 direction. The sheet transport apparatus 38 can move obliquely the sheet S once, instead of moving the sheet S in the perpendicular direction and the axis line C1 direction in two steps.

The processing control unit 25 drives the second motor 50B, and does not drive the first motor 50A. A first regulation switching unit 56B is set to the first regulation release state, and a second regulation switching unit 56A is set to the second regulation transmission state (second sorting).

When the second motor 50B is driven, the drive shaft 50*b*B rotates in the direction D5. The second motor 50B applies torque. When the second collar 47B rotates in the first direction D1, the torque is transmitted from the second collar 47B to the first collar 43B through the second drive switching unit 46B. The torque is transmitted from the first collar 43B to the second end portion 33*e* of the drive discharge roller 33.

Figure 8:
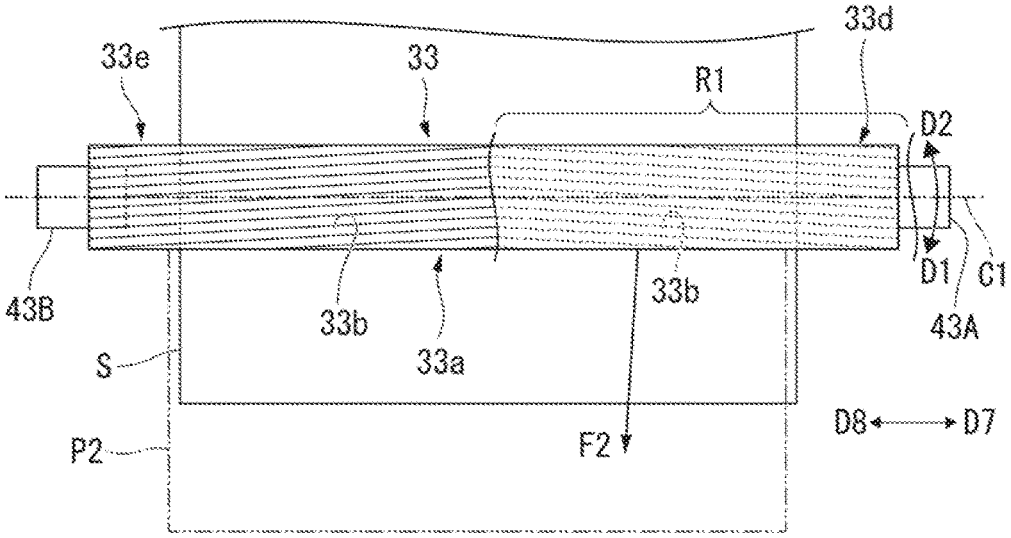
FIG. 8 is a plan and partial cut-away view of the drive discharge roller in a second twist state.

Since the first regulation switching unit 56B is in the first regulation release state, torque provided by the first regulation unit 58B is not applied to the second end portion 33*e* of the drive discharge roller 33. Since the second regulation switching unit 56A is in the second regulation transmission state, torque provide by the second regulation unit 58A is applied to the first end portion 33*d* of the drive discharge roller 33. The first collar 43A freely rotates in the first direction D1 around the axis line C1 with respect to the second collar 47A by the first drive switching unit 46A. The magnitude of torque applied by the second motor 50B is greater than the magnitude of torque applied by the second regulation unit 58A. As illustrated in FIG. 8, the second end portion 33*e* of the drive discharge roller 33 is twisted in the first direction D1 with respect to the first end portion 33*d*. The drive discharge roller 33 is easily returned from the first twist state to the initial state by the elastic force of the coil 42. Hereinafter, a state in which the drive discharge roller 33 is twisted in this manner is referred to as a second twist state. The second twist state is a state in which the discharge roller 33 is twisted in a direction opposite to that of the first twist state.

The sheet S in contact with the drive discharge roller 33 is moved in a direction F2 perpendicular to each groove 33*b* in contact with the sheet S, without changing a direction of the sheet S. In other words, the sheet S transported by the drive discharge roller 33 in the second twist state is transported not only in the perpendicular direction but also in a second direction D8 (parallel to the C1 direction). The sheet S is thereby moved to a position P2.

In the above process, the second sorting for sorting the sheets S in the second direction D8 is completed.

The processing control unit 25 sets the first regulation switching unit 56B to the first regulation release state, and the second regulation switching unit 56A to the second regulation release state. The first motor 50A and the second motor 50B are driven at the same rotation speed. The drive discharge roller 33 rotates in the first direction D1 in the initial state illustrated in FIG. 5. The sheet S is transported in the perpendicular direction (i.e., the sheet transport direction) without moving in the C1 direction.

The first sorting and the second sorting are alternately repeated. The sheets S are alternately staggered in the C1 direction.

Details of the sorting of the sheets S can be appropriately set by operating the control panel 12.

As described above, the sheet transport apparatus 38 of the embodiment rotates the drive discharge roller 33 around the axis line C1 by the rotation mechanism 39, in a state where the drive discharge roller 33 is twisted around the axis line C1 by the twist mechanism 40. The sheet S in contact with the drive discharge roller 33 can be moved not only in the sheet transport direction but also in the C1 direction in a short time.

On the outer periphery surface of the drive discharge roller 33, the uneven surface 33*a* is formed. With the drive discharge roller 33 set to either the first twist state or the second twist state, it is possible to move the sheet S in the C1 direction.

The groove 33*b* extending along the axis line C1 is formed on the uneven surface 33*a*. The sheet S is moved in a direction perpendicular to a direction in which the groove 33*b* is twisted in the spiral shape. The direction to which the sheet S is moved becomes easy to understand.

The rotation mechanism 39 includes the first motor 50A, and the twist mechanism 40 includes the first regulation unit 58B. It is possible to set the drive discharge roller 33 to be in the first twist state.

The rotation mechanism 39 includes the second motor 50B, and the twist mechanism 40 includes the second regulation unit 58A. It is possible to set the drive discharge roller 33 to the second twist state twisted in a direction opposite to the twisted direction of the first twist state.

The sheet transport apparatus 38 includes the drive switching units 46A and 46B, the regulation switching units 56A and 56B, and the processing control unit 25. When the first motor 50A applies torque, it is possible to selectively suppress the second motor 50B from interfering. When the second motor 50B applies torque, it is possible to selectively suppress the first motor 50A from interfering.

The coil 42 is positioned within the cylindrical space 33*c* of the drive discharge roller 33. By the elastic force of the coil 42, the drive discharge roller 33 is easily returned from the first twist state and the second twist state to the initial state.

The shaft 44 is disposed within the cylindrical space 42*a* of the coil 42. The shaft 44 supports the inside of drive discharge roller 33 and prevents collapse of the discharge roller 33 in a radial direction.

The sheet processing apparatus 21 includes the sheet transport apparatus 38. By using the sheet transport apparatus 38 which can move the sheet S not only in the sheet transport direction but also in the C1 direction in a short time, it is possible to effectively use the sheet processing apparatus 21 according to a desired sorting operation.

The drive discharge roller 33 is a sheet transport roller closest to the fixed tray 24*a* of the second sheet discharging unit 24. In a state where the sheets S are staggered in the axis line C1 direction, it is possible to discharge the sheet S to an outside of the sheet processing apparatus 21.

Figure 9:
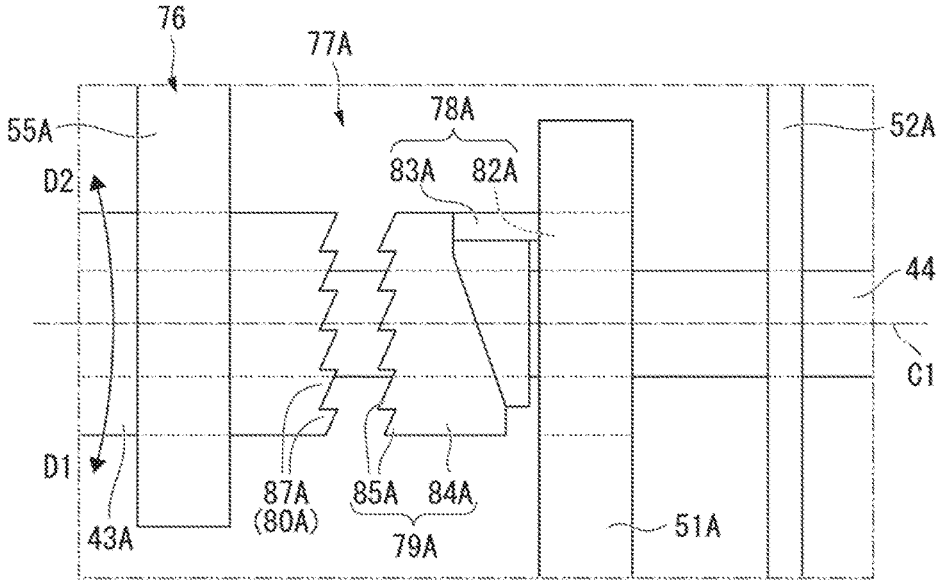
FIG. 9 is a plan view of a first drive switching unit in a modification example of the embodiment.

In a modified embodiment, a sheet transport apparatus 76 as illustrated in FIG. 9 may be provided. A first drive switching unit 77A may be provided instead of the first drive switching unit 46A and the second collar 47A of the sheet transport apparatus 38. The first drive switching unit 77A includes a connection member 78A, a first ratchet gear 79A, and a second ratchet gear 80A.

The connection member 78A includes a supporting plate 82A rotatably supported around the shaft 44 and a pin member 83A protruding from the supporting plate 82A toward the first collar 43A. The drive belt 51A is wound around the supporting plate 82A.

The first ratchet gear 79A includes a gear main body 84A and a plurality of first teeth units 85A. The gear main body 84A is formed in the cylindrical shape. The gear main body 84A is rotatably supported around the shaft 44. On an outer periphery surface of the gear main body 84A, an inclined surface 84*a*A recessed from the outer periphery surface is formed. A portion of the outer periphery surface of the gear main body 84A of an opposite side to the first collar 43A is recessed. The inclined surface 84*a*A is inclined to approach to the first collar 43A toward the second direction D2 in the circumferential direction of the gear main body 84A. The plurality of first teeth units 85A are provided on an end surface facing the first collar 43A of the gear main body 84A. Each of the first teeth units 85A includes an outer surface approximately in parallel with the axis line C1, and an outer surface intersecting the axis line C1.

A tip end portion of a pin member 83A of the connection member 78A is into contact with the inclined surface 84*a*A of the first ratchet gear 79A. The pin member 83A can be rotated around the shaft 44 with respect to the first ratchet gear 79A along the inclined surface 84*a*A. A range in which the pin member 83A rotates with respect to the first ratchet gear 79A is limited. When the pin member 83A reaches an end portion of a movement range, the pin member 83A integrally rotates with the first ratchet gear 79A.

The second ratchet gear 80A includes a plurality of second teeth units 87A. The plurality of second teeth units 87A are provided on an end surface facing the first ratchet gear 79A in the first collar 43A. Each of the second teeth units 87A includes an outer surface approximately in parallel with the axis line C1, and an outer surface intersecting the axis line C1.

Each second teeth unit 87A is engaged with each first teeth unit 85A of the first ratchet gear 79A. When each second teeth unit 87A and each first teeth unit 85A are engaged, the first drive switching unit 77A regulates rotation of the first ratchet gear 79A in the first direction D1 around the axis line C1 with respect to the first collar 43A and the second ratchet gear 80A. The first drive switching unit 77A allows that the first ratchet gear 79A rotates in the second direction D2 around the axis line C1 with respect to the first collar 43A and the second ratchet gear 80A.

Figure 10:
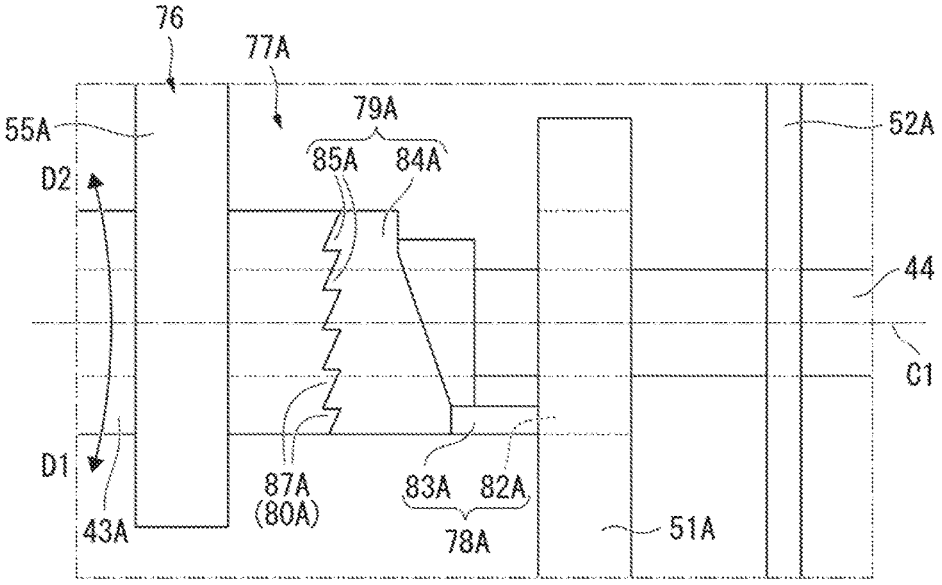
FIG. 10 is a plan view at the time of operating the first drive switching unit.

Initially, the first ratchet gear 79A and the second ratchet gear 80A are separated from each other in the axis line C1 direction. When the first motor 50A is driven, the connection member 78A rotates in the first direction D1 around the axis line C1. As illustrated in FIG. 10, the pin member 83A of the connection member 78A rotates in the first direction D1 while being in contact with the inclined surface 84*a*A of the first ratchet gear 79A. The pin member 83A moves the first ratchet gear 79A to approach to the second ratchet gear 80A. Each second teeth unit 87A and each first teeth unit 85A are then engaged. Torque applied by the first motor 50A is applied to the first end portion 33*d* of the drive discharge roller 33 through the drive belt 51A and the first drive switching unit 77A. By the torque, the first end portion 33*d* of the drive discharge roller 33 rotates in the first direction D1.

The drive of the first motor 50A is stopped and the second motor 50B is driven. Torque applied by the second motor 50B is transmitted to the second end portion 33*e* of the drive discharge roller 33 through the second drive switching unit 46B or a second drive switching unit configured similar to the first drive switching unit 77A. Each second teeth unit 87A and each first teeth unit 85A are then disengaged. The first ratchet gear 79A is thus separated from the second ratchet gear 80A, and returns to a state illustrated in FIG. 9.

The first ratchet gear 79A and the second ratchet gear 80A are not connected to each other. When the second motor 50B applies the torque, the first motor 50A does not oppose the torque.

In the embodiment, the uneven surface 33*a* includes the plurality of grooves 33*b*. However, a shape of the uneven surface is not limited thereto. The uneven portion may be a so-called knurled shape or the like. For example, the knurled shape is formed with a plurality of first spiral grooves formed in a first direction around the axis line C1 and a plurality of second spiral grooves formed in a second direction around the axis line C1.

An outer periphery surface of the drive discharge roller 33 may also be flat, without forming the uneven surface 33*a* on the outer periphery surface of the drive discharge roller 33.

The rotation mechanism 39 may not include the second motor 50B, and the twist mechanism 40 may not include the second regulation unit 58A. By the first motor 50A of the rotation mechanism 39 and the first regulation unit 58B of the twist mechanism 40, it is possible to set the drive discharge roller 33 in the first twist state. At this time, the sheet transport apparatus 38 may not include the drive switching units 46A and 46B and the regulation switching units 56A and 56B.

If rigidity of the drive discharge roller 33 is relatively high or the like, the sheet transport apparatus 38 may not also include the coil 42.

The roller is the drive discharge roller 33. The roller is not limited thereto, and the discharge roller 70 may also be implemented as the roller, because the discharge roller 70 is a sheet transport roller closest to a movable tray 24*b* of the second sheet discharging unit 24, on a transport path including the second transport path 32 and the processing tray 65, among a plurality of sheet transport rollers. The roller of the embodiment may also be provided in the image forming apparatus 11.

According to at least one embodiment described above, by implementing the drive discharge roller 33, the rotation mechanism 39, and the twist mechanism 40, it is possible to move the sheet S in contact with the drive discharge roller 33 not only in the sheet transport direction but also in the C1 direction in a short time.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet transport apparatus comprising:

a roller having a surface formed from an elastic material and configured to transport a sheet;

a rotation mechanism configured to rotate the roller around an axis of the roller; and a twist mechanism configured to selectively twist the roller with respect to the axis so that:

when the roller is twisted and the rotation mechanism rotates the roller, a sheet transported by the roller is transported in a first direction perpendicular to the axis and in a second direction parallel to the axis, and when the roller is not twisted and the rotation mechanism rotates the roller, a sheet transported by the roller is transported in the first direction and not in the second direction, wherein the surface of the roller includes an uneven surface with at least one groove formed thereon, the at least one groove extending along the axis when the roller is not twisted.

2. The apparatus according to claim 1, wherein the at least one groove includes a plurality of grooves evenly spaced circumferentially around the roller when the roller is not twisted.

3. The apparatus according to claim 1, wherein:

the rotation mechanism includes a first drive unit configured to apply, to a first end portion of the roller, a first torque to rotate the roller in a first direction around the axis, the twist mechanism includes a first regulation unit configured to apply, to a second end portion of the roller opposite the first end, a second torque to rotate the roller in a second direction around the axis opposite the first direction, and a magnitude of the first torque applied by the first drive unit is greater than a magnitude of the second torque applied by the first regulation unit.

4. The apparatus according to claim 3, wherein the rotation mechanism includes a second drive unit configured to apply, to the second end portion of the roller, a third torque to rotate the roller in the first direction around the axis, the twist mechanism includes a second regulation unit configured to apply, to the first end portion of the roller, a fourth torque to rotate the roller in the second direction around the axis, and a magnitude of the third torque applied by the second drive unit is greater than a magnitude of the fourth torque applied by the second regulation unit.

5. The apparatus according to claim 1, wherein the roller includes:

a coil positioned inside the elastic material, and a shaft member positioned inside the coil.

6. A sheet transport method comprising the steps of:

providing a roller having a surface formed from an elastic material and configured to transport a sheet;

twisting the surface of the roller with respect to the axis; and conveying a sheet by rotating the roller around an axis of the roller while the surface of the roller is twisted so that the sheet transported by the roller is transported in a first direction perpendicular to the axis and in a second direction parallel to the axis, wherein when the roller is rotated while the surface of the roller is not twisted, a sheet transported by the roller is transported in the first direction and not in the second direction.

7. The method according to claim 6, wherein the surface of the roller includes an uneven surface.

8. The method according to claim 7, wherein at least one groove is formed on the uneven surface, the at least one groove extending along the axis when the roller is not twisted.

9. The method according to claim 8, wherein the at least one groove includes a plurality of grooves evenly spaced circumferentially around the roller when the roller is not twisted.

10. The method according to claim 6, wherein:

the step of twisting the surface of the roller includes:

applying a first torque, to a first end portion of the roller, to rotate the roller in a first direction around the axis, and applying a second torque, to a second end portion of the roller opposite the first end, to rotate the roller in a second direction around the axis opposite the first direction; and a magnitude of the first torque applied to the first end portion is greater than a magnitude of the second torque applied to the second end portion.

11. The method according to claim 6, wherein the roller includes:

a coil positioned inside the elastic material, and a shaft member positioned inside the coil.

12. A sheet processing apparatus comprising:

a processing unit configured to perform a process on one or more sheets; and a sheet transport apparatus including at least:

a roller having a surface formed from an elastic material and configured to transport a sheet, a rotation mechanism configured to rotate the roller around an axis of the roller, and a twist mechanism configured to selectively twist the roller with respect to the axis so that:

when the roller is twisted and the rotation mechanism rotates the roller, a sheet transported by the roller is transported in a first direction perpendicular to the axis and in a second direction parallel to the axis, and when the roller is not twisted and the rotation mechanism rotates the roller, a sheet transported by the roller is transported in the first direction and not in the second direction, wherein the surface of the roller includes an uneven surface with at least one groove formed thereon, the at least one groove extending along the axis when the roller is not twisted.

13. The apparatus according to claim 12, wherein the at least one groove includes a plurality of grooves evenly spaced circumferentially around the roller when the roller is not twisted.

14. The apparatus according to claim 12, wherein:

the rotation mechanism includes a first drive unit configured to apply, to a first end portion of the roller, a first torque to rotate the roller in a first direction around the axis, the twist mechanism includes a first regulation unit configured to apply, to a second end portion of the roller opposite the first end, a second torque to rotate the roller in a second direction around the axis opposite the first direction, and a magnitude of the first torque applied by the first drive unit is greater than a magnitude of the second torque applied by the first regulation unit.

15. The apparatus according to claim 14, wherein the rotation mechanism includes a second drive unit configured to apply, to the second end portion of the roller, a third torque to rotate the roller in the first direction around the axis, the twist mechanism includes a second regulation unit configured to apply, to the first end portion of the roller, a fourth torque to rotate the roller in the second direction around the axis, and a magnitude of the third torque applied by the second drive unit is greater than a magnitude of the fourth torque applied by the second regulation unit.

16. The apparatus according to claim 12, wherein the roller is configured to transport a sheet to a sheet discharge tray so that multiple sheets are alternately staggered on the discharge tray in a width direction of the sheets.

17. The apparatus according to claim 12, wherein the roller is configured to transport a sheet from the processing unit to a moveable sheet discharge tray so that multiple sheets are alternately staggered on the moveable discharge tray in a width direction of the sheets.

* * * * *